US007810298B1

(12) United States Patent
Sorkin

(10) Patent No.: US 7,810,298 B1
(45) Date of Patent: Oct. 12, 2010

(54) PAVING RISER ASSEMBLY FOR SUPPORTING REBARS IN STACKED AND/OR INTERSECTION RELATIONSHIP

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 271 days.

(21) Appl. No.: 11/844,326

(22) Filed: Aug. 23, 2007

(51) Int. Cl.
*E04C 5/16* (2006.01)

(52) U.S. Cl. ..... 52/685; 52/686; 52/719; 404/136

(58) Field of Classification Search ..... 52/633, 52/677, 684–689, 719; 404/61–63, 135, 404/136

See application file for complete search history.

(56) References Cited

U.S. PATENT DOCUMENTS 3,673,753 A 7/1972 Anderson
3,788,025 A 1/1974 Holmes
4,835,933 A 6/1989 Yung
5,555,693 A 9/1996 Sorkin
5,791,095 A 8/1998 Sorkin
5,893,252 A * 4/1999 Hardy et al. ..... 52/685
6,276,108 B1 * 8/2001 Padrun ..... 52/684
6,557,317 B2 * 5/2003 Sorkin ..... 52/684
7,108,453 B2 * 9/2006 Harris ..... 404/135
7,322,158 B1 * 1/2008 Sorkin ..... 52/685
7,469,515 B2 * 12/2008 Minor ..... 52/719
7,506,482 B2 * 3/2009 Sorkin ..... 52/685

* cited by examiner

*Primary Examiner*—David Dunn
*Assistant Examiner*—Adam Barlow
(74) *Attorney, Agent, or Firm*—Egbert Law Offices PLLC

(57) ABSTRACT

A bar support apparatus has a first body with a first clamping structure and a second clamping structure extending from a top thereof, and a second body having a first clamping structure and a second clamping structure extending downwardly from a bottom thereof. The clamping structures of the second body engage the clamping structures of the first body. The second body also has a third clamping structure and a fourth clamping structure extending upwardly from a top thereof. A rebar is received within first and second clamping structures of the first and second bodies.

4 Claims, 2 Drawing Sheets

PAVING RISER ASSEMBLY FOR SUPPORTING REBARS IN STACKED AND/OR INTERSECTION RELATIONSHIP

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to devices for use in connection with construction. More particularly, the present invention relates to a reinforcing bar chair apparatus for use in reinforced concrete construction. Furthermore, the present invention relates to intersectional chairs used with reinforced concrete construction. The present invention also relates to chairs that are used to allow rebars to be placed in stacked parallel relationship to each other.

2. Description of Related Art Including Information Disclosed Under 37 CFR 1.97 and 37 CFR 1.98

For a concrete floor on a prepared surface, spacers or chairs are utilized for providing the vertical separation of the rebar grid from the surface on which the concrete is to be poured. The prepared surface may be a wood, plywood, or foam structure or a compacted surface, the latter of which my be provided with a layer of compacted sand, with a plastic sheet covering thereon providing a moisture barrier. Spacers or chairs are then positioned on the prepared surface for supporting the rebars in a plane generally parallel to the prepared surface. Typically, with modern building codes, a spacer is needed for every linear foot of the rebar.

With rebar spacers or chairs, one common problem is occasioned by the number of different sizes required to be maintained by a supplier to accommodate different thicknesses of poured concrete, such as two-inch, three-inch, four-inch, etc., and many intermediate fractional sizes. Another common problem with rebar spacers has been encountered in the method of securing the rebar to the chair or spacer, with twisted wire being the most common method. This particular problem is more acute when mutually perpendicular layers of rebar are coupled to the same chairs or spacers. With wire connections, a first strip of wire secures the first layer and a second strip of wire secures the perpendicular layer of rebar. With any metal or wire within the reinforcing bar grid work, there is a problem with rusting or corrosion of the wire or metal components.

In the past, various patents have issued relating to these chair supports for reinforcing rods. In particular, the present inventor is the owner of U.S. Pat. Nos. 5,555,693 and 5,791, 095 for such chairs. Each of these chairs has a receiving area with a horizontal section and a generally parabolic section extending transverse to the horizontal section. A plurality of separate legs extends downwardly from the receiving area. Each of the legs has a foot extending horizontally outwardly therefrom. The receiving area and the plurality of legs are integrally formed together of a polymeric material.

U.S. Pat. No. 3,788,025, issued on Jan. 29, 1974 to S. D. Holmes, describes a chair for supporting in right angular relation two reinforcing rods used in construction. The chair has a lower arched base part and an upper rod supporting part integral with the base. The base is an arched support with means for providing lateral, longitudinal, and vertical support and strength. The rod supporting part comprises two spaced apart arms, the lower parts of which form a saddle for receiving one reinforcing rod and the upper part for each of which is formed by two separately spaced upstanding inwardly concave arms, the upper ends of which are spaced to provide an opening through which a second reinforcing rod, arranged at a right angle to the first rod, may be introduced.

U.S. Pat. No. 3,673,753, issued on Jul. 4, 1972 to G. C. Anderson, teaches a concrete reinforcing bar support in which a base supports an upright pedestal. A lower clamping portion is supported by the pedestal which has a first rod-receiving open passageway therethrough. Resilient detents extend from the lower clamping portion to retain a reinforcing rod disposed through the first passageway. An upper clamping portion is provided which includes a pair of hook members extending from the lower clamping portion. Each of the hook members has a mouth opening in the same direction to define a second rod-receiving passageway which is normally disposed to the first passageway.

U.S. Pat. No. 4,835,933 issued on Jun. 6, 1989 to F. P Yung, describes a spacer assembly which includes a spacer with a body having a base portion with a generally centrally disposed support post portion. One end of the support post portion is formed as a planar surface with a centrally located generally concave saddle portion configured for receiving a reinforcing bar. The planar surface is provided with apertures therethrough on both sides of the saddle. A clamp member is provided for simultaneously securing mutually perpendicular rebars to the chair. The clamp member is a generally U-shaped lower portion, with the depending arms thereof spaced in generally parallel relationship for engaging a first bar within the saddle. A generally identical pair of hook arms extends upwardly from the bight portion. The hook arms are oriented for engaging a second rebar in an orientation perpendicular to the first rebar engaged within the saddle portion.

U.S. Pat. No. 5,893,252, issued on Apr. 13, 1999 to Hardy, Jr. et al, teaches an apparatus for fixating and elevating an interconnected rebar lattice having individual longitudinal and transverse rebar intersections. The apparatus includes a holding portion having an open-ended recess with two opposing walls being generally U-shaped. The recess has longitudinal access and is sized and shaped to receive a longitudinal rod. An arc-shaped portion extends laterally outwardly from each opposing wall and perpendicular to the longitudinal access of the recess. The arc-shaped portion includes a recess and an opposing wall with each wall including a snap-type lock. A locking member has a generally arc-type portion and includes a snaptype lock for attaching to the arc-type portion and engaging with the snap-type lock of the arc-type portion. A leg portion extends downwardly from the holding portion and is integrally attached to a base.

Under certain circumstances, during the construction of concrete structures, it is often desirable to cause rebars to be maintained in generally stacked parallel relationship to each other. For example, certain depths of concrete may need a pair of rebars in spaced parallel relationship to be assembled within the concrete structure. Additionally, chairs must be utilized so as to allow the rebars to extend in alternately transverse and/or parallel relationship. In the past, it has been extremely difficult to stack one reinforcing bar chair upon another. Platforms would have to be developed so as to allow the overlying relationship. In other circumstances, a very difficult technique of utilizing tying wires were used so as to allow one chair to be stacked upon the other chair. As such, a need developed so as to allow the chairs to be connected in overlying relationship in a simple and efficient manner.

It is an object of the present invention to provide a bar support which is corrosion-proof.

It is another object of the present invention to provide a bar support that is adaptable to receive various diameters of rebar therein.

It is another object of the present invention to provide a bar support adapted for use at intersections of rebars.

It is another object of the present invention to provide a bar support that can be placed on various flat surfaces.

It is another object of the present invention to provide a bar support that can be easily snap-fitted onto and locked around a reinforcing bar.

It is another object of the present invention to provide a bar support which allows a free flow of concrete therethrough.

It is a further object of the present invention to provide a bar support with a load-resistant stable support structure.

It is a further object of the present invention to provide a reinforcing bar support which is easy to use, easy to manufacture and relatively inexpensive.

It is a further object of the present invention to provide a reinforcing bar support that allows the rebars to be placed in a stacked overlying relationship to each other.

It is a further object of the present invention to provide a reinforcing bar support which allows the chairs to be stacked one upon another in a simple and efficient manner.

It is still another object of the present invention to provide a paving riser assembly wherein the rebars can be arranged in transverse relationship to each other or longitudinal aligned relationship to each other, or a mixture thereof, without requiring special types and configurations of chairs.

These and other objects and advantages of the present invention will become apparent from a reading of the attached specification and appended claims.

BRIEF SUMMARY OF THE INVENTION

The present invention is a bar support apparatus that comprises a first body having a bottom suitable for resting on an underlying surface and a second body positionable on the top of first body. The first body has a first clamping structure extending upwardly from a top thereof and a second clamping structure in spaced relationship to the first clamping structure. The second clamping structure also extends upwardly from the top of the body. The second body has a first clamping structure and second clamping structure extending downwardly from a bottom thereof. The second body also has a third clamping structure and a fourth clamping structure extending upwardly from a top thereof. The first and second clamping structures of second body are engaged with the first and second clamping structures of the first body.

In the present invention, a rebar can extend through a channel formed through the first and second clamping structures of the second body and the first and second clamping structures of the first body. Also, a channel can be formed in the top of the first body and positioned between the first and second clamping structures of the first body.

Each of the clamping structures of the of the first body has a first curved element extending upwardly from the top of the first body, and a second curved element extending upwardly from the top of the first body such that a concavity of the first curved element faces a concavity of the second curved element. The second curved element is offset laterally along the top of the first body from the first curved element. Each of the first and second curved element has a bayonet extending outwardly from a side opposite the concavity.

The first clamping structure of the second body comprises a first curved element extending downwardly from the bottom of the second body and a second curved element extending downwardly from the bottom of the second body. The first curved element has an interior surface contacting a surface of the first curved element of the first clamping structure and the first body opposite the concavity. The second curved element has an interior surface contacting a surface of the first curved element of the second clamping structure and the first body opposite the concavity. The first curved element of the first clamping structure of the second body is in snap-fit relationship with the first curved element of the first clamping structure of the first body. The second curved element of the first clamping structure of the second body is in snap-fit relationship with the second curved element of the first clamping structure of the first body. Each of the curved elements has an insert surface extending upwardly from a top of the curved elements and in a direction away from the concavity.

In the present invention, a channel formed in the top of the second body between the third clamping structure and the fourth clamping structure thereof. The first clamping structure of the second body has a notch formed on an inner surface thereof. This notch serves to receive the bayonet therein. The first body and the second body are vertically aligned with each other.

DETAILED DESCRIPTION OF THE INVENTION

Figure 1:
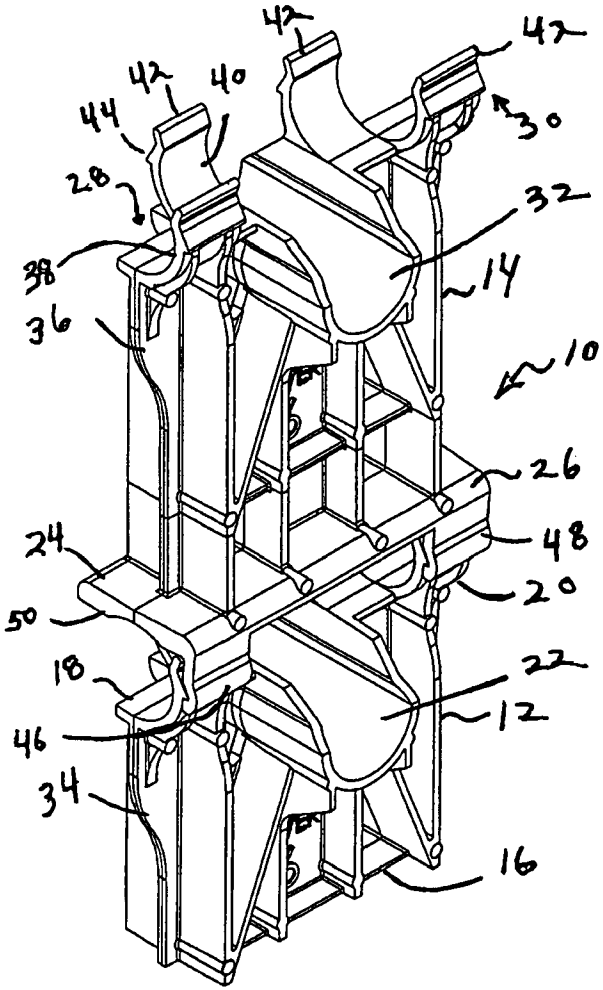
FIG. 1 is a perspective view of the paving riser assembly in accordance with the teachings of the present invention.

Referring to FIG. 1, there is shown the paving riser assembly 10 in accordance with the preferred embodiment of the present invention. The paving riser assembly 10 includes a first body 12 and a second body 14 extending in generally vertically aligned relationship to each other. The first body 12 has a bottom 16 suitable for resting upon an underlying surface so as to allow the body 12 to extend upwardly from the underlying surface. The body 12 includes a first clamping structure 18 and a second clamping structure 20 formed at the top of the first body 12. A channel 22 is formed between the first clamping structure 18 and second clamping structure 20 so as to extend generally transversely to the pathway extending between the first clamping structure 18 and the second clamping structure 20.

The second body 14 has a configuration somewhat similar to that of the first body 12. However, the second body 14 includes a first clamping structure 24 and a second clamping structure 26 extending from a bottom 50 of the body 14. The body 14 also includes a third clamping structure 28 and fourth clamping structure 30 extending upwardly from the top of the body 14. A channel 32 is formed in the top of the body 14 between the third clamping structure 28 and the fourth clamping structure 30.

It can be seen that each of the bodies 12 and 14 has generally latticed surfaces. The arrangement of structural struts, bars, cross members and vertical members allows the polymeric bodies 12 and 14 to achieve a maximum structural integrity. This is accomplished while minimizing the amount of polymeric material that must be required for the formation of each of the bodies 12 and 14. In particular, it can be seen that gussets 34 extend vertically along opposite sides of the body 12. Gussets 36 extend vertical along and outwardly of the sides of the second body 14. The upper ends of each of the gussets 34 and 36 are widened so as to accommodate the clamping structures 18, 20, 28 and 30. As such, these gussets 34 and 36 achieve a strong structural integrity for the paving riser assembly 10.

In FIG. 1, the second body 14 includes the third clamping structure 28 and the fourth clamping structure 30. Each of the clamping structures 28 and 30 includes first curved elements 38 and 40. The curved elements 38 and 40 have interior concavities that generally face each other. The curved element 38 is laterally offset from the curved element 40. There is an insert surface 42 on the curved elements 38 and 40. This insert surface 42 extends upwardly and outwardly from a top of each of the curved elements 38 and 40. The insert surfaces 42 facilitate the ability to place a rebar into the spaces between the concavities of the curved elements 38 and 40. It can further be seen that each of the curved elements 38 and 40 includes a bayonet 44 extending outwardly from a surface of the curved elements opposite the concavity thereof. The bayonet 44 is suitable for allowing a snap-fit engagement with another second body 14 placed thereabove, if desired.

In FIG. 1, it can also be seen that the second body 14 includes a downwardly extending element 46 on one side of the first clamping structure 24 of the second body 14 and a downwardly extending element 48 extending downwardly from the second clamping structure 26. These downwardly extending elements 46 and 48 extend over an outer surface of the respective curved elements of the first clamping structure 18 and the second clamping structure 20 of the first body 12. A notch arrangement formed on the inner surfaces of the downwardly extending elements 46 and 48 which engage the bayonet formed on the clamping structures 18 and 20. As a result, the bottom 50 of the second body 14 will overlie a top of a rebar extending through the clamping structures 18 and 20 so as to retain the rebar therein.

Figure 2:
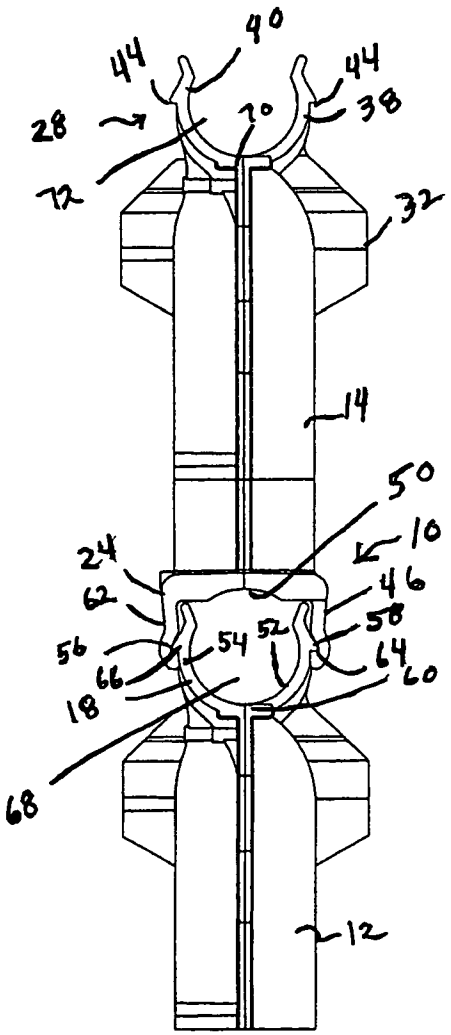
FIG. 2 is a side elevational view of the paving riser assembly of the preferred embodiment of the present invention.

FIG. 2 further illustrates the positioning of the second body 14 over the first body 12 of the paving riser assembly 10. It can been seen that the second body 14 is vertically aligned with the first body 12. In FIG. 2, the first clamping structure 24 of the second body 14 is engaged with the first clamping structure 18 of the first body 12. The first clamping structure 18 of the first body 12 includes a first curved element 52 and a second curved element 54. Each of the curved elements 52 and 54 has a concavity on an inner surface which faces the concavity of the other of the curved elements 52 and 54. A bayonet 56 is formed on the surface of the first curved element 52 opposite the concavity. Similarly, a bayonet 58 is formed on the opposite side of the second curved element 54 from the concavity thereof. Each of the curved elements 52 and 54 extend upwardly from the top 60 of the first body 12.

The second body 14 has its first clamping structure 24 in snap-fit engagement over the outer sides of the curved elements 52 and 54 of the first clamping structure 18 of the first body 12. In particular, the first clamping structure 24 includes a first downwardly extending element 46 and a second downwardly extending element 62. The first downwardly extending element 46 includes a notch 64 which receives the bayonet 58 of the second curved element 54. The second downwardly extending element of the first clamping structure 24 of the second body 14 also includes a notch 66 which receives the bayonet 56 of the first curved element 52. In this arrangement, the first clamping structure 24 of the second body 14 can be easily snap fit upon the first clamping structure 18 of the first body 12 so that the bodies 14 and 12 are vertically aligned and so that any rebar extending through the channel 68 is retained within curved elements 52 and 54 and by the bottom 50 of the second body 14.

A similar arrangement of snap-fit connections and curved elements makes up the second clamping structure 20 of the first body 12 and the second clamping structure 26 of the second body 14.

In FIG. 2, the first clamping structure 28 is illustrated at the top 70 of the second body 14. As was described in association with FIG. 1, the first clamping structure 28 includes the first curved element 38 and the second curved element 40. Bayonets 44 are formed on the outer surface of each of the curved elements 38 and 40. The curved elements 38 and 40 have an interior configured so as to receive the outer surfaces of a rebar extending through the channel 72 defined by the interior surfaces of the curved elements 38 and 40 and by the top 70 of the second body 14. A channel 32 is illustrated as positioned below the channel 72 so as to allow intersectional rebars to be accommodated by the paving riser assembly 10 of the present invention.

Figure 3:
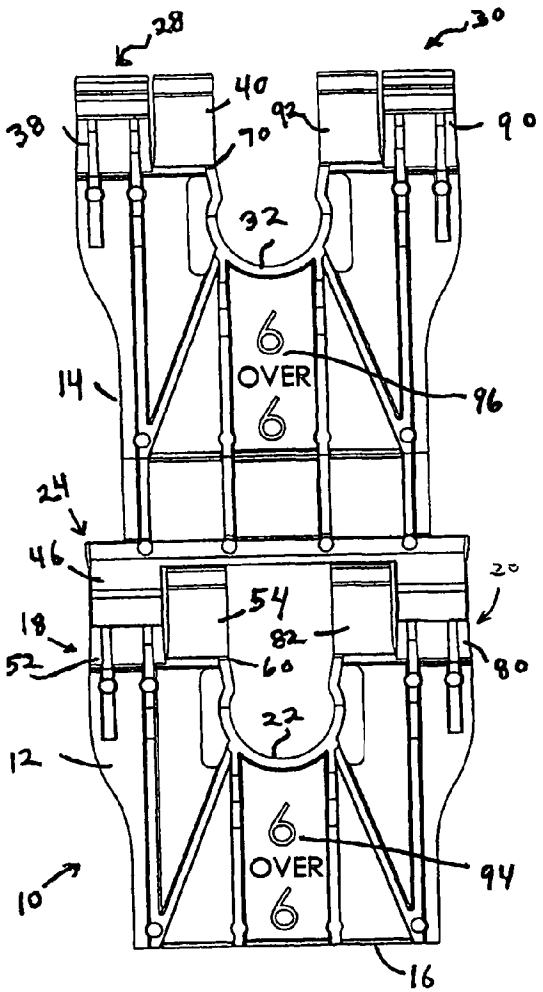
FIG. 3 is a frontal view of the paving riser assembly in accordance with the preferred embodiment of the present invention.

FIG. 3 is a frontal view of the paving riser assembly 10 of the present invention. In particular, the first body 12 has a bottom 16 suitable for causing the assembly 10 to be placed upon an underlying surface, such as a deck. The first body 12 has its first clamping structure 18 formed on one side thereof and its second clamping structure 20 formed on an opposite side thereof. The first clamping structure 18 includes first curved element 52 and second curved element 54 in laterally offset relationship to each other. The first curved element 46 of the first clamping structure 24 of second body 14 is in snap-fit relationship with the first curved element 52 of the first clamping structure 18 of the first body 12. The second clamping structure 20 of the first body 12 also has a first curved element 80 and a second curved element 82 extending in laterally offset relationship to each other along the top 60 of the first body 12. The channel 22 is located between the first clamping structure 18 and the second clamping structure 20.

FIG. 3 also shows the third clamping structure 28 and the fourth clamping structure 30 formed at the top 70 of the second body 14. It can be seen that the third clamping structure 28 is formed of the first curved element 38 and the second curved element 40. The fourth clamping structure 30 is formed of the first curved element 90 and the second curved element 92. The curved elements 38 and 40 are in laterally offset relationship to each other. The curved elements 90 and 92 are in laterally offset relationship to each other. In each of circumstances, the concavities associated with the curved elements 38 and 40 will face each other. Similarly, the concavities of curved elements 90 and 92 will generally face each other. Channel 32 is located between the third clamping structure 28 and the fourth clamping structure 30.

In FIG. 3, it can be seen that a first alphanumeric indicia 94 is illustrated in the center of the first body 12. A second alphanumeric indicia 96 is located in center of the second body 14. The alphanumerical indicia 94 and 96 are indicative of the heights of the respective bodies 12 and 14. The "6 over 6" indication on each of the bodies 12 and 14 in FIG. 3 shows that a six inch paving chair is placed over another six inch paving chair. As such, the worker can easily determine the height of each of the paving chairs of the paving riser assembly 10 of the present invention.

Each of the bodies 12 and 14, along with their associated clamping structures, is formed of polymeric material in an injection molding process. As such, the paving riser assembly 10 of the present invention can be easily manufactured, in mass quantities, at a relatively minimal cost. The polymeric material can include a nylon material which will withstand the strong forces which are imparted by rebars that are received within the respective channels formed by the clamping structures and/or by the respective bodies 12 and 14.

Figure 4:
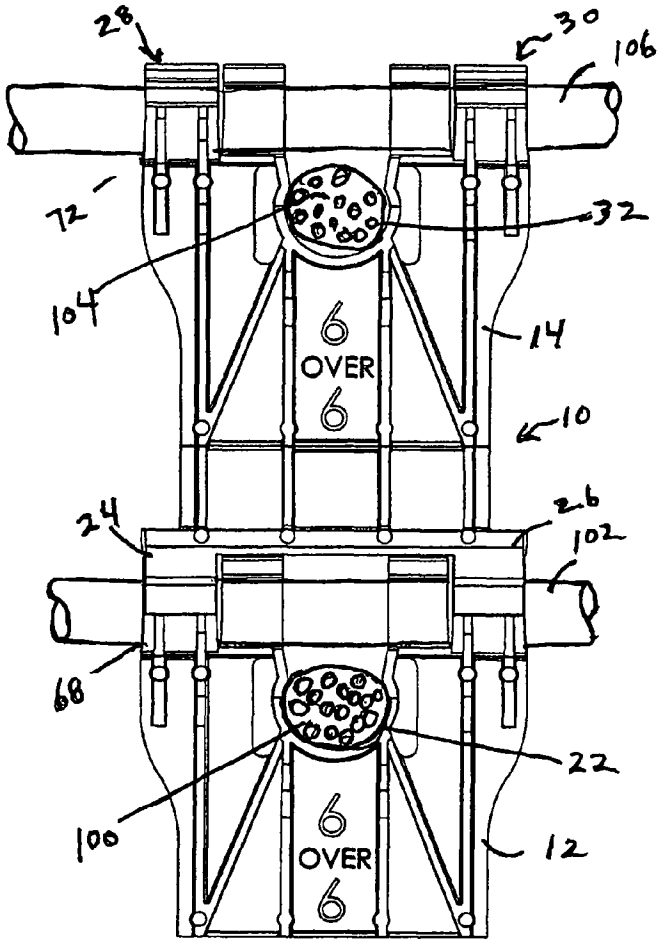
FIG. 4 is a frontal view showing the paving riser assembly of the present invention with rebars extending through the clamping structures thereof.

FIG. 4 illustrates how the respective rebars can be received within the channels of the paving riser assembly 10 of the present invention. In FIG. 4 a rebar 100 is illustrated as extending through the channel 22 of the first body 12. Another rebar 102 is illustrated as received in the channel 68 formed by the respective clamping structures 24 and 26. In this arrangement, the rebar 100 will extend in transverse relationship to rebar 102. The second body 14 extends vertically above the rebar 102 such that the clamping structures 28 and 30 are positioned at the opposite end of the body 14 from the rebar 102. A rebar 104 will extend through the transverse channel 32 of the second body 14. Another rebar 106 is formed in the channel 72 defined by the clamping structures 28 and 30. As a result, the rebar 106 will extend in transverse relationship to the rebar 104. Rebars 102 and 106 are arranged in spaced parallel relationship to each other. Rebars 100 and 104 are also arranged in spaced parallel relationship to each other. As such, the paving riser assembly 10 of the present invention can effectively function as an intersectional chair or as an double-deck chair for supporting rebars in spaced parallel relationship, or a combination thereof The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A bar support apparatus comprising:

a first body having a bottom suitable for resting on an underlying surface, said first body having a first clamping structure extending upwardly from a top of said body and a second clamping structure in spaced relationship to said first clamping structure, said second clamping structure extending from said top of said body, said first and second clamping structures defining a channel therethrough, said channel having a longitudinal axis, each of said first and second clamping structures comprising:

a first curved element extending upwardly from said top of said body on one side of said channel, said first curved element having a continuous curvature extending in an arc of greater than 90°, said first curved element having a bayonet extending outwardly from a curved side thereof; and a second curved element extending upwardly from said top of said body on an opposite side of said channel, said second curved element having a continuous curvature extending in an arc of greater than 90°, said first curved element being longitudinally offset from said second curved element along said longitudinal axis of said channel, said second curved element having a bayonet extending outwardly of a curved side thereof; and a second body having a first clamping structure and a second clamping structure extending downwardly from a bottom of said second body, said second body having a third clamping structure and a fourth clamping structure extending upwardly from a top of said second body, said first and second clamping structures of said second body being engaged with the bayonets of said first and second clamping structures of said first body such that said first and second clamping structures of said second body overlap the curved side of the first and second curved elements of said first and second clamping structures of said first body.

2. The bar support apparatus of claim 1, further comprising:

a rebar extending through said channel.

3. The bar support apparatus of claim 1, further comprising:

another channel formed in said top of said first body and positioned between said first and second clamping structures of said first body.

4. The bar support apparatus of claim 1, said first clamping structure of said second body comprising:

a first curved element extending downwardly from said bottom of said second body, said first curved element having an interior surface contacting the curved side of said first curved element of said first clamping structure of said first body opposite the concavity; and a second curved element extending downwardly from said bottom of said second body, said second curved element having an interior surface contacting the curved side of said first curved element of said second clamping structure of said first body opposite the concavity.

* * * * *